US010350735B2

(12) United States Patent
Hsu

(10) Patent No.: US 10,350,735 B2
(45) Date of Patent: Jul. 16, 2019

(54) OPEN-END WRENCH

(71) Applicant: YuTu Hsu, Taichung (TW)

(72) Inventor: YuTu Hsu, Taichung (TW)

(73) Assignee: Son Yuios Industrial Co., Ltd., Taichung (TW)

( * ) Notice: Subject to any disclaimer, the term of this patent is extended or adjusted under 35 U.S.C. 154(b) by 19 days.

(21) Appl. No.: 15/851,745

(22) Filed: Dec. 22, 2017

(65) Prior Publication Data

US 2018/0117741 A1 May 3, 2018

(51) Int. Cl.
*B25B 13/28* (2006.01)
*B25B 23/00* (2006.01)

(52) U.S. Cl.
CPC ..... *B25B 13/28* (2013.01); *B25B 23/0007* (2013.01)

(58) Field of Classification Search
CPC ..... B25B 13/28; B25B 13/46; B25B 23/00; B25B 23/0007
See application file for complete search history.

(56) References Cited

U.S. PATENT DOCUMENTS 2,846,912 A * 8/1958 Day ..... B25B 13/08 81/111
4,276,790 A * 7/1981 Davis ..... B25B 13/46 81/62
4,825,731 A * 5/1989 Stojanowski ..... B25B 13/08 81/111
5,018,412 A * 5/1991 Wylie, III ..... B25B 13/46 81/111
5,996,445 A * 12/1999 Wiens ..... B25B 13/46 81/111
7,131,354 B1 * 11/2006 Huang ..... B25B 13/08 81/90.1
7,886,636 B1 * 2/2011 Mills ..... B25B 13/46 81/111
8,342,063 B2 * 1/2013 Stanton ..... B25B 13/08 81/179
8,342,064 B2 * 1/2013 Lin ..... B25B 13/46 81/179
8,701,528 B2 * 4/2014 Wu ..... B25B 13/46 181/126
9,827,652 B2 * 11/2017 Mills ..... B25B 13/46

* cited by examiner

*Primary Examiner* — David B. Thomas

(57) ABSTRACT

An open-end wrench is provided. A push head of an operating handle is accommodated in a coupling slot of a jaw. A portion of an inclined guide surface, first and second clamping surfaces and a swing support point normally extend to a jaw opening. When the open-end wrench is used to screw or unscrew a hexagonal screw member, a first entrance guide surface and a second entrance guide surface of the jaw guide a pair of sides of the hexagonal screw member for the hexagonal screw member to enter the jaw opening, and five sides of the hexagonal screw member can be clamped quickly to enhance the convenience for screwing or unscrewing the hexagonal screw member. In addition, the hexagonal screw member won't slide out of the jaw opening during the backswing process of the operating handle so as to screw or unscrew the hexagonal screw member stably.

5 Claims, 12 Drawing Sheets

OPEN-END WRENCH

FIELD OF THE INVENTION

The present invention relates to an open-end wrench, and more particularly, to an open-end wrench which can enhance the convenience for screwing or unscrewing a hexagonal screw member. When in use, five sides of the hexagonal screw member can be simultaneously clamped by the open-end wrench to screw or unscrew the hexagonal screw member stably.

BACKGROUND OF THE INVENTION

Socket wrenches are used for screwing or unscrewing hexagonal screw members (such as screws or nuts). Due to a clamping push force applied by six sides or six corners, a solid and stable output effect can be achieved. The wrench may cooperate with a one-way ratchet gear mechanism to form a ratchet wrench having a turning function. However, the socket wrench is sleeved on the hexagonal screw member only in the axial direction. For hexagonal screw members of a pipe connector (such as nuts for pipe fitting), an open-end wrench is used to screw or unscrew the hexagonal screw members. The jaw of the open-end wrench is formed with a jaw opening for guiding a hexagonal screw member. Relative to the shape of the hexagonal screw member, at least a pair of sides of the hexagonal screw member cannot be applied with a force by the jaw of the wrench, which will affect the operation of the wrench. As a result, the hexagonal screw member cannot be screwed stably. The operation of the handle of the open-end wrench has a backswing limit of 360 degrees. The opening of the jaw needs to be in and out at two different sides of the hexagonal screw member, which affects the continuous operation for screwing the hexagonal screw member. A conventional quick open-end wrench based on the structure of a clamp is disclosed. The clamping space of the jaw can be changed to achieve the function of a backswing operation. However, its two clamping arms only act on three sides of a screw member. The wrench cannot screw the screw member stably. The mechanism for controlling the opening or closing of the jaw increases the complexity of the structure. The structure of the open-end wrench cannot be simplified. Another conventional ratchet wrench capable of operating continuously is disclosed. The ratchet wrench has a jaw opening formed by two clamping arms. The jaw opening is normally open so that two opposite sides of a hexagonal screw can be directly inserted into the jaw opening for performing a backswing operation. Although the ratchet wrench is able to clamp four sides of the hexagonal screw member, the open jaw opening may cause the hexagonal screw member to slide out of the jaw opening easily. During the process that the wrench is used to screw a hexagonal screw member, the hexagonal screw member may slide out of the jaw opening (affecting the stability of the operation). In the embodiment as shown in FIG. 13, an end of an extension sleeve 30 (movable arm) is bent to form an end surface 56 which acts on the fifth side of a hexagonal screw member to increase an output point or surface, thereby preventing the hexagonal screw member from sliding out of the jaw opening. But, this design affects or hinders the hexagonal screw member from entering the jaw opening. Accordingly, the inventor of the present invention has devoted himself based on his many years of practical experiences to solve these problems.

SUMMARY OF THE INVENTION

The primary object of the present invention is to provide an open-end wrench comprising an operating handle and at least one jaw. The operating handle includes a handle portion. At least one end of the handle portion is provided with a push head. The push head has a pivot hole. One side of a front end of the pivot hole extends obliquely to form a push portion having a substantially pointed cone shape, and another side of the front end of the pivot hole extends obliquely and outwardly to form a support portion connected with the push portion. A front end surface of the push portion connected with the support portion is formed with an inclined guide surface, a first clamping surface, a second clamping surface, a turning surface, a backswing limit surface and a support end surface arranged in sequence. The inclined guide surface is an inward inclined plane formed at a front end of the push portion. The first clamping surface is inclined inwardly and connected to an inner end of the inclined guide surface. The second clamping surface is inclined outwardly and connected to an inner end of the first clamping surface. The second clamping surface is inclined at an angle to match with an included angle between two adjacent sides of a hexagonal screw member. The turning surface is inclined inwardly and connected to an inner end of the second clamping surface. The junction of the turning surface and the second clamping surface forms a swing support point. The backswing limit surface is inclined outwardly and connected to an inner end of the turning surface and serves as a stepped extension surface of the second clamping surface. The support end surface is connected to an inner end of the backswing limit surface, and is inclined inwardly to connect an outer edge of the support portion. The support end surface is formed with a hole. The hole is provided with an elastic member therein. The jaw has a C-like shape. The jaw has a connecting hole corresponding to the pivot hole of the push head of the operating handle. One side of a front end of the connecting hole extends obliquely to form an extension arm, and another side of the front end of the connecting hole is bent obliquely to form a clamping arm connected with the extension arm. A jaw opening is defined between the extension arm and the clamping arm. The jaw has a coupling slot which extends from a root of the clamping arm to a position close to a front end of the extension arm and is in communication with the jaw opening and passes through an outer side edge of the extension arm. The coupling slot is formed with a swing limit end face near the front end of the extension arm and a push end face at the root of the clamping arm. The push head of the operating handle is mounted in the coupling slot by a pivot member inserted in the connecting hole and the pivot hole so that the jaw is pivotally connected to the push head of the operating handle. A gap is defined between the support end surface and the push end surface. The push end surface is biased by the elastic member so that the swing limit end surface abuts against the front end of the inclined guide surface to restrict the jaw from swinging in a direction on the push head. A peripheral end surface of the jaw opening formed by the extension arm and the clamping arm is formed with a first entrance guide surface, a concave curved surface, a convex curved surface, a third clamping surface, a fourth clamping surface and a second entrance guide surface arranged in sequence. The first entrance guide surface is formed on an inner edge of the front end of the extension arm and is tangent to the inclined guide surface so that a portion of the inclined guide surface extends to the jaw opening. The concave curved surface is connected to the first entrance guide surface. The first clamping surface and the second clamping surface extend to the jaw opening. The convex curved surface is connected to the concave curved surface and is formed at the root of the clamping arm and symmetrical to the swing support point. The third clamping surface is connected to the convex curved surface and cooperates with the first clamping surface to match two opposite sides of the hexagonal screw member. The fourth clamping surface is connected to the third clamping surface and cooperates with the second clamping surface to match two opposite sides of the hexagonal screw member. The second entrance guide surface is connected to the fourth clamping surface and formed on an inner edge of a front end of the clamping arm. The second entrance guide surface cooperates with the first entrance guide surface to match two opposite sides of the hexagonal screw member for guiding the hexagonal screw member to enter the jaw opening.

When the user wants to use the open-end wrench to screw or unscrew the hexagonal screw member, the first entrance guide surface and the second entrance guide surfaces at the front ends of the extension arm and the clamping arm of the jaw guide a pair of sides of the hexagonal screw member. During the process that the hexagonal screw member enters the jaw opening, a corner of the hexagonal screw member is first in contact with the inclined guide surface to be guided. The second entrance guide surface of the jaw is pushed by one side of the hexagonal screw member to generate a corresponding swing motion, and then the first clamping surface following the inclined guide surface guides one side of the hexagonal screw member so that the hexagonal screw member is completely guided to enter the jaw opening. It is only required that the swing support point holds against the inner side of the hexagonal screw member as a rotation point, and the push portion is operated to rotate a small angle by the handle portion of the operating handle. The second entrance guide surface is linked to move away from the initial side of the hexagonal screw member. By the elastic push force applied to the push end surface by the elastic member, on that moment, the first, second, third and fourth clamping surfaces and the convex curved surface simultaneously clamp five sides of the hexagonal screw member. The five sides of the hexagon screw member can be clamped by the open-end wrench so that the hexagonal screw member can be screwed or unscrewed. When the user wants to stop screwing the hexagonal screw member, the handle portion is swung back. The swing support point holds against the inner side of the hexagonal screw member as a rotation point again, and the pushed head is swung back. The convex curved surface of the jaw is pushed by another inner side of the hexagonal screw member so that the included angle between the third and fourth clamping surfaces is moved away from a corner of the hexagonal screw member. During the position change, four corners of the hexagonal screw member abut against the first clamping surface, the third clamping surface, the backswing limit surface and the convex curved surface. The swing support point leaves the inner side of the hexagonal screw member. The second clamping surface is turned to the other inner side of the hexagonal screw member. The first, second, third and fourth clamping surfaces and the convex curved surface are restored to clamp the five sides of the hexagonal screw member. The hexagonal screw member can be screwed or unscrewed by the handle portion. According to the open-end wrench of the present invention, the push head of the operating handle is accommodated in the coupling slot of the jaw. The portion of the inclined guide surface, the first and second clamping surfaces and the swing support point normally extend to the jaw opening. When the open-end wrench is used to screw or unscrew the hexagonal screw member, the first entrance guide surface and the second entrance guide surface of the jaw guide the pair of sides of the hexagonal screw member for the hexagonal screw member to enter the jaw opening, and the five sides of the hexagonal screw member can be clamped quickly to enhance the convenience for screwing or unscrewing the hexagonal screw member. In addition, the hexagonal screw member won't slide out of the jaw opening during the backswing process of the operating handle so as to screw or unscrew the hexagonal screw member stably.

Preferably, the first entrance guide surface of the jaw is formed with an outward slanted guide surface at a front end thereof. When the first entrance guide surface and the second entrance guide surface are used for guiding the pair of sides of the hexagonal screw member, the outward slanted guide surface is configured to guide the pair of sides of the hexagonal screw member to the first entrance guide surface and the second entrance guide surface.

Preferably, an outer edge of the front end of the extension arm of the jaw is formed with a rounded corner connected with the first entrance guide surface. When the front end of the extension arm contacts the hexagonal screw member, the rounded corner facilitates the pair of sides of the hexagonal screw member to be slid to the first and second entrance guide surfaces.

Preferably, an outer edge of the front end of the clamping arm of the jaw is formed with a rounded corner connected with the second entrance guide surface. When the front end of the clamping arm contacts the hexagonal screw member, the rounded corner facilitates the pair of sides of the hexagonal screw member to be slid to the first and second entrance guide surfaces.

Preferably, the elastic member in the hole of the support end surface is a compression spring. A cap-shaped push member is provided at an outer end of the elastic member. An outer end of the push member is formed with a spherical surface. The spherical surface is against the push end surface. The spherical surface of the push member acts on the push end surface with low friction resistance, so that the push head and the jaw can be turned or swung more flexibly.

DETAILED DESCRIPTION OF THE PREFERRED EMBODIMENTS

Embodiments of the present invention will now be described, by way of example only, with reference to the accompanying drawings.

Figure 1:
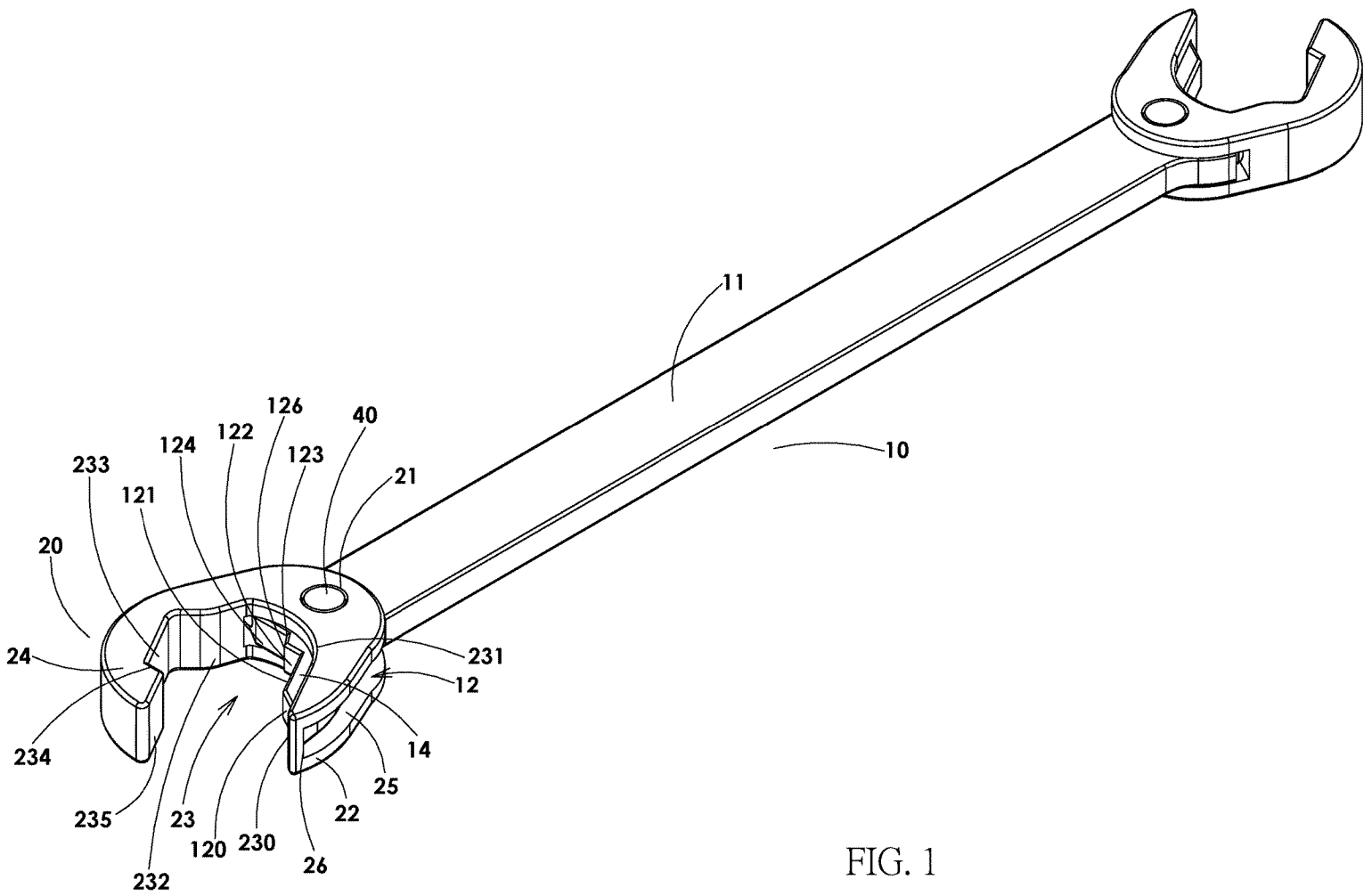
FIG. 1 is a perspective view of the present invention.
Figure 2:
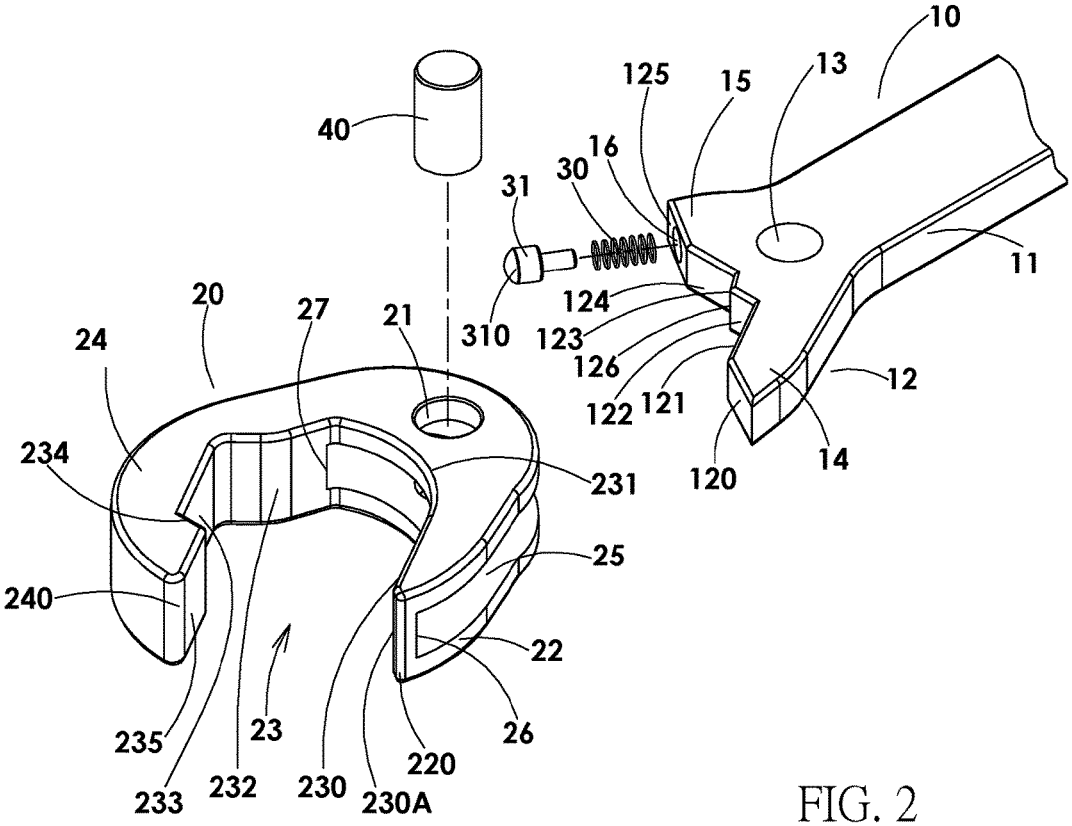
FIG. 2 is an exploded view of the present invention.
Figure 3:
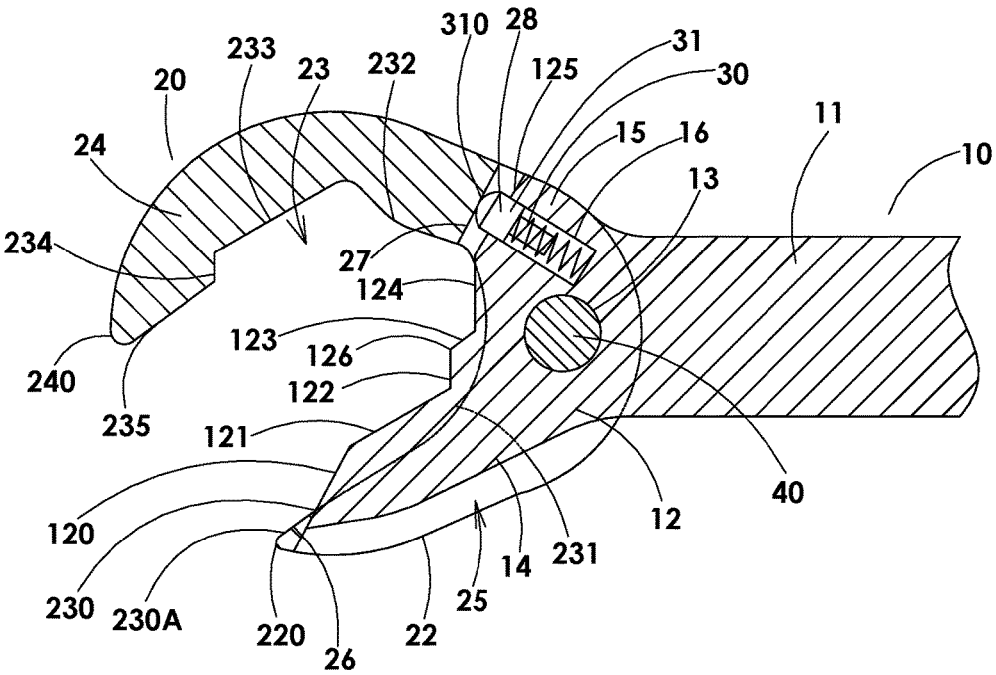
FIG. 3 is a sectional view of the present invention.

As shown in FIG. 1, FIG. 2, and FIG. 3, an open-end wrench in accordance with the present invention comprises an operating handle 10 and at least one jaw 20. The operating handle 10 includes a handle portion 11. At least one end of the handle portion 11 is provided with a push head 12. A middle portion of the push head 12 is formed with a pivot hole 13. One side of a front end of the pivot hole 13 extends obliquely to form a push portion 14 having a substantially pointed cone shape, and another side of the front end of the pivot hole 13 extends obliquely and outwardly to form a support portion 15 connected with the push portion 14. A front end surface of the push portion 14 connected with the support portion 15 is formed with an inclined guide surface 120, a first clamping surface 121, a second clamping surface 122, a turning surface 123, a backswing limit surface 124 and a support end surface 125 arranged in sequence. The inclined guide surface 120 is an inward inclined plane formed at a front end of the push portion 14 having the pointed cone shape. The first clamping surface 121 is inclined inwardly and connected to an inner end of the inclined guide surface 120. The second clamping surface 122 is inclined outwardly and connected to an inner end of the first clamping surface 121. The second clamping surface 122 is inclined at an angle to match with an included angle between two adjacent sides of a hexagonal screw member. The turning surface 123 is inclined inwardly and connected to an inner end of the second clamping surface 122. The junction of the turning surface 123 and the second clamping surface 122 forms a swing support point 126. The backswing limit surface 124 is inclined outwardly and connected to an inner end of the turning surface 123 and serves as a stepped extension surface of the second clamping surface 122. The support end surface 125 is connected to an inner end of the backswing limit surface 124, and is inclined inwardly to connect an outer edge of the support portion 15. The support end surface 125 is formed with a hole 16. The hole 16 is provided with an elastic member 30 therein.

The jaw 20 has a C-like shape. The jaw 20 has a connecting hole 21 corresponding to the pivot hole 13 of the push head 12 of the operating handle 10. One side of a front end of the connecting hole 21 extends obliquely to form an extension arm 22, and another side of the front end of the connecting hole 21 is bent obliquely to form a clamping arm 24 connected with the extension arm 22. A jaw opening 23 is defined between the extension arm 22 and the clamping arm 24. The jaw 20 has a coupling slot 25 which extends from the root of the clamping arm 24 to a position close to a front end of the extension arm 22 and is in communication with the jaw opening 23 and passes through an outer side edge of the extension arm 22. The coupling slot 25 is formed with a swing limit end face 26 near the front end of the extension arm 22 and a push end face 27 at the root of the clamping arm 24. The push head 12 of the operating handle 10 is mounted in the coupling slot 25 by a pivot member 40 inserted in the connecting hole 21 and the pivot hole 13 so that the jaw 20 is pivotally connected to the push head 12 of the operating handle 10. A gap 28 is defined between the support end surface 125 and the push end surface 27. The push end surface 27 is biased by the elastic member 30 so that the swing limit end surface 26 abuts against the front end of the inclined guide surface 120 to restrict the jaw 20 from swinging in a direction on the push head 12. A peripheral end surface of the jaw opening formed by the extension arm 22 and the clamping arm 24 is formed with a first entrance guide surface 230, a concave curved surface 231, a convex curved surface 232, a third clamping surface 233, a fourth clamping surface 234 and a second entrance guide surface 235 arranged in sequence. The first entrance guide surface 230 is formed on an inner edge of the front end of the extension arm 22 and is tangent to the inclined guide surface 120 so that a portion of the inclined guide surface 120 extends to the jaw opening 23. The concave curved surface 231 is connected to the first entrance guide surface. The first clamping surface 121 and the second clamping surface 122 extend to the jaw opening 23. The convex curved surface 232 is connected to the concave curved surface 231 and is formed at the root of the clamping arm 24 and symmetrical to the swing support point 126. The third clamping surface 233 is connected to the convex curved surface 232 and cooperates with the first clamping surface 121 to match two opposite sides of the hexagonal screw member. The fourth clamping surface 234 is connected to the third clamping surface 233 and cooperates with the second clamping surface 122 to match two opposite sides of the hexagonal screw member. The second entrance guide surface 235 is connected to the fourth clamping surface 234 and formed on an inner edge of a front end of the clamping arm 24. The second entrance guide surface 235 cooperates with the first entrance guide surface 230 to match two opposite sides of the hexagonal screw member for guiding the hexagonal screw member to enter the jaw opening 23.

Figure 4:
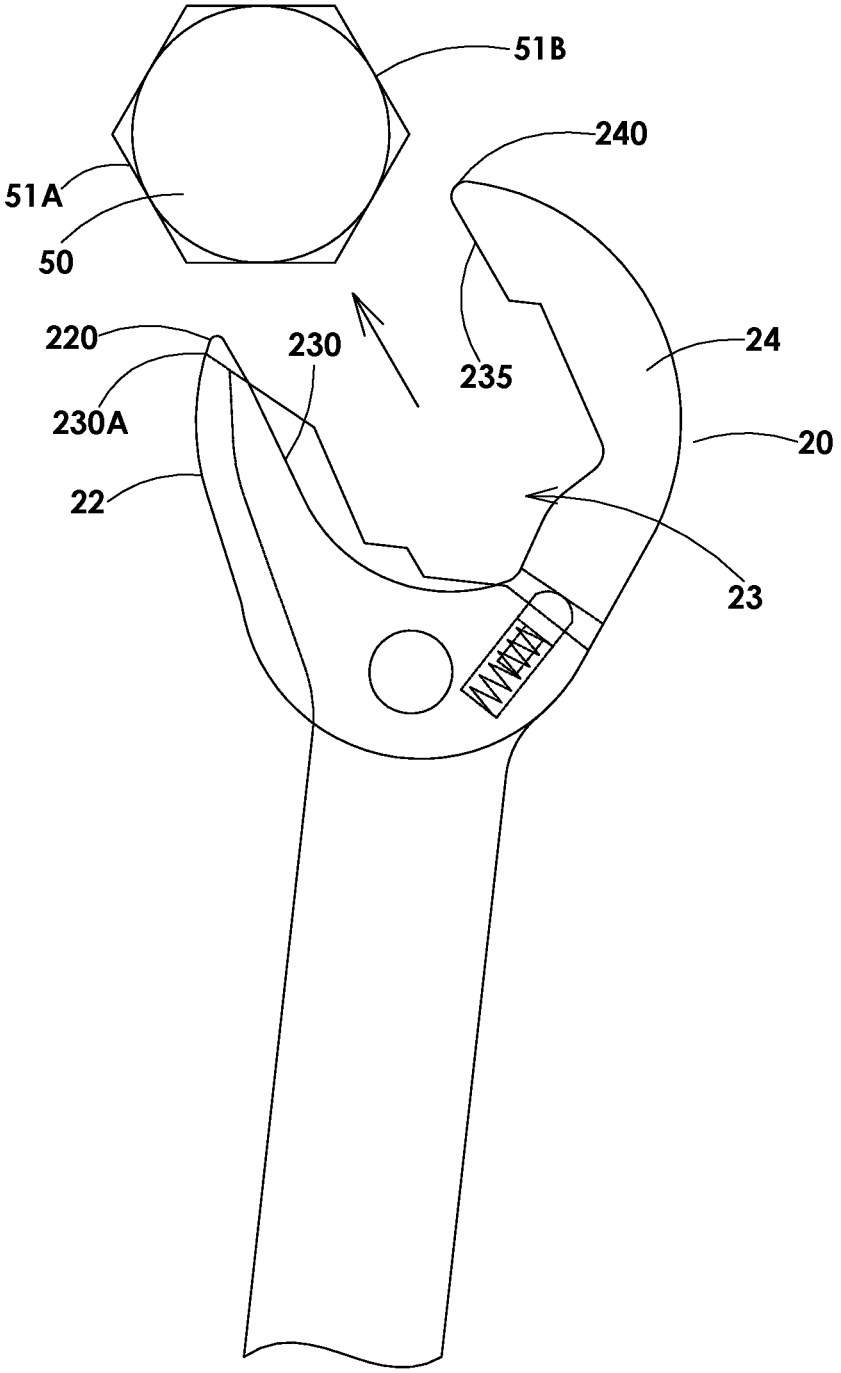
FIG. 4 is a schematic view of the present invention when in use, illustrating the hexagonal screw member before guided to the jaw opening.
Figure 5:
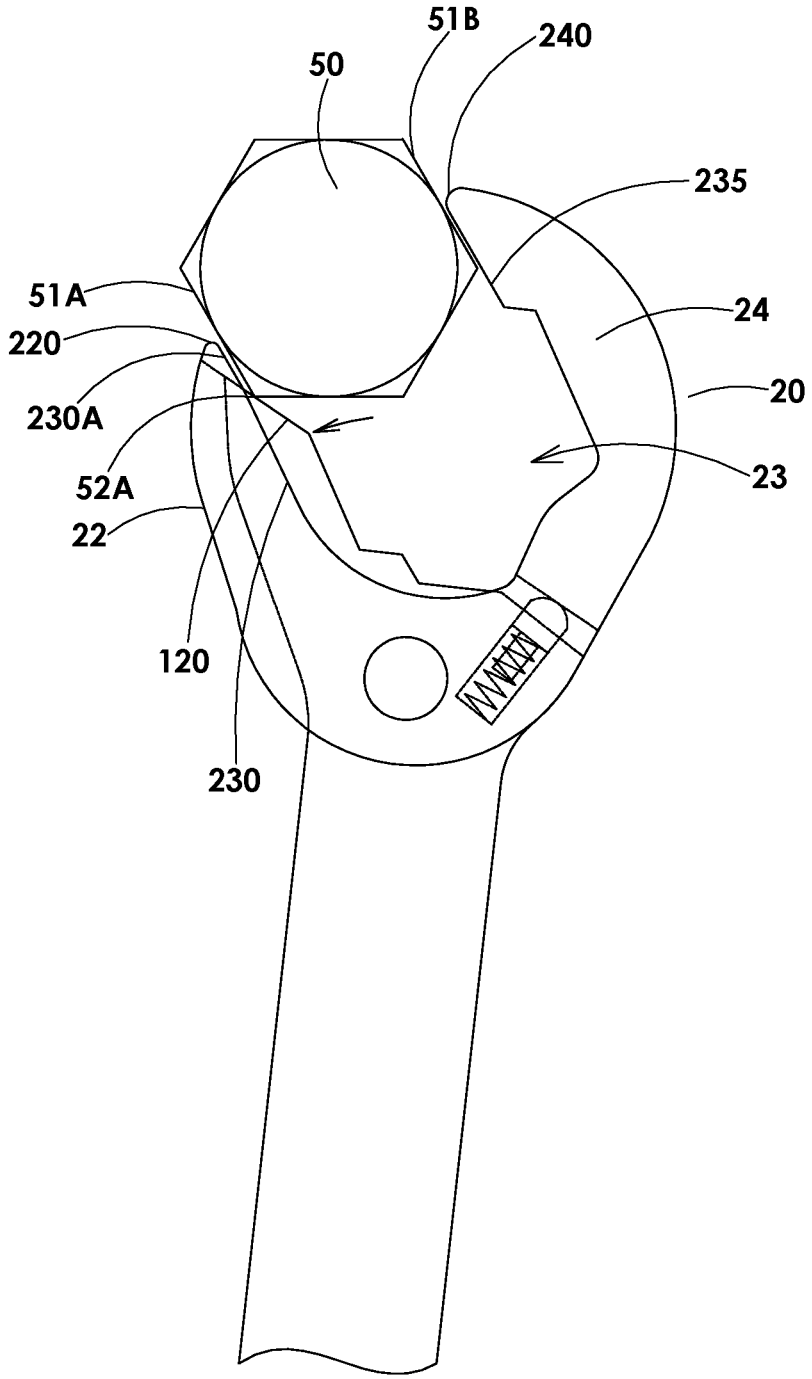
FIG. 5 is a schematic view of the present invention when in use, illustrating that the first and second entrance guide surfaces guide a pair of sides of the hexagonal screw member and one corner of the hexagonal screw member is in contact with the inclined guide surface.
Figure 6:
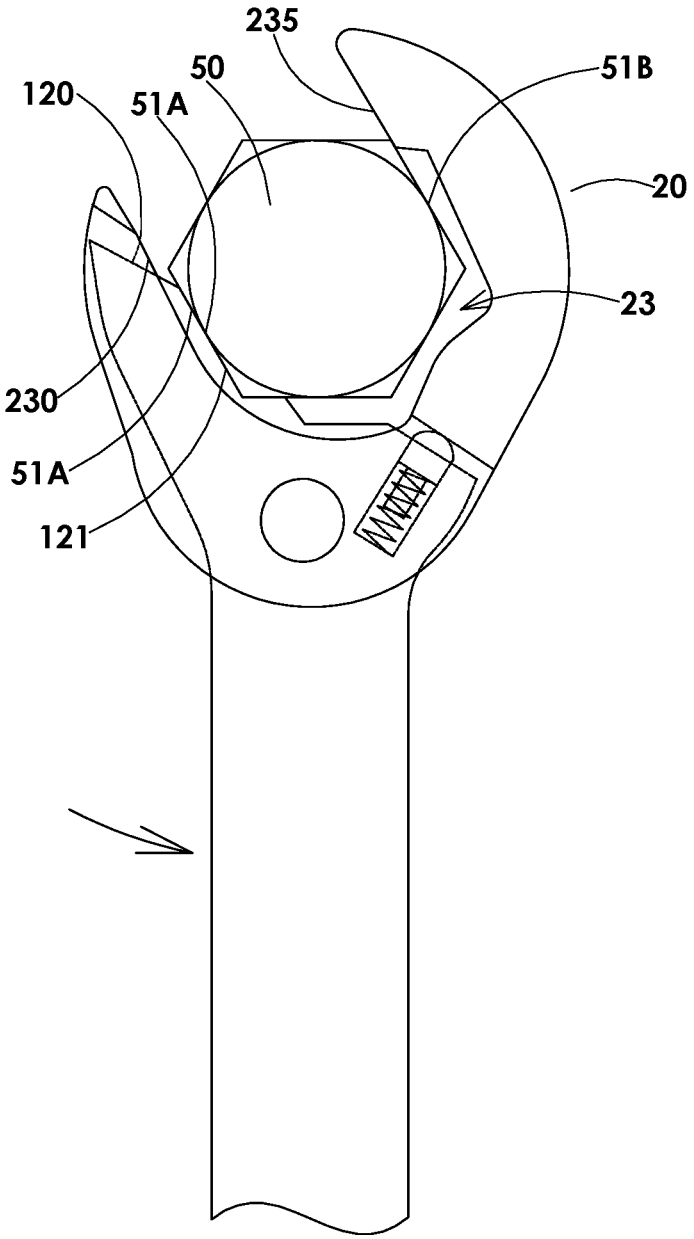
FIG. 6 is a schematic view of the present invention when in use, illustrating that the inclined guide surface guides the hexagonal screw member to enter the jaw opening.
Figure 7:
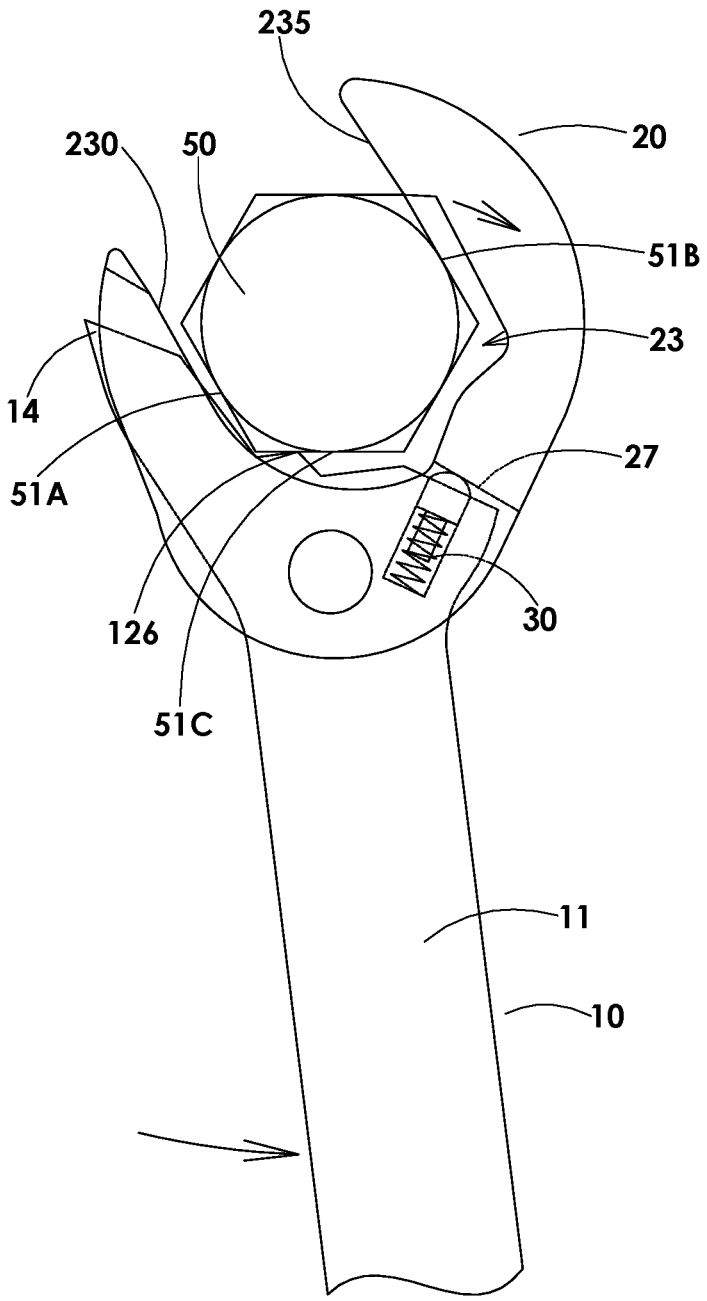
FIG. 7 is a schematic view of the present invention when in use, illustrating that the swing support point holds against the innermost side of the hexagonal screw member to turn a small angle.
Figure 8:
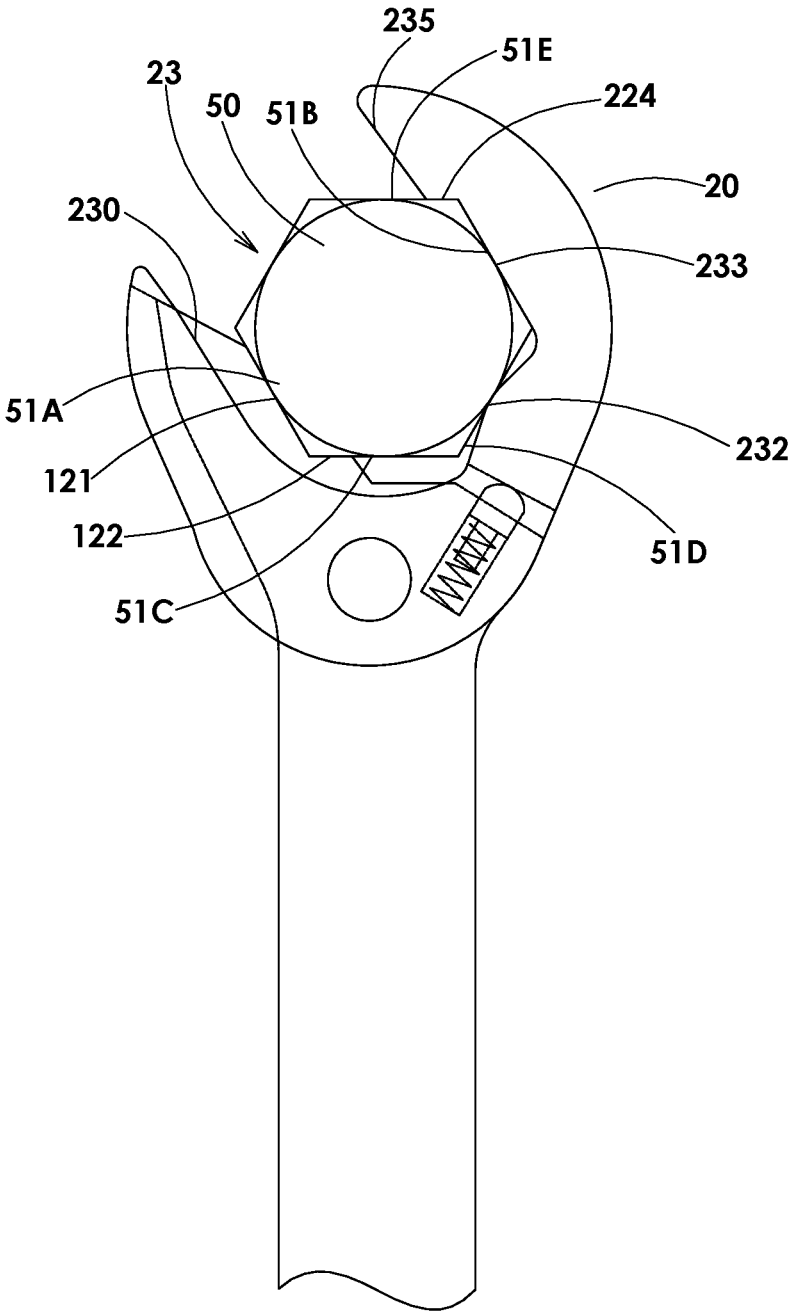
FIG. 8 is a schematic view of the present invention when in use, illustrating that five sides of the hexagonal screw member are clamped by the jaw opening.
Figure 9:
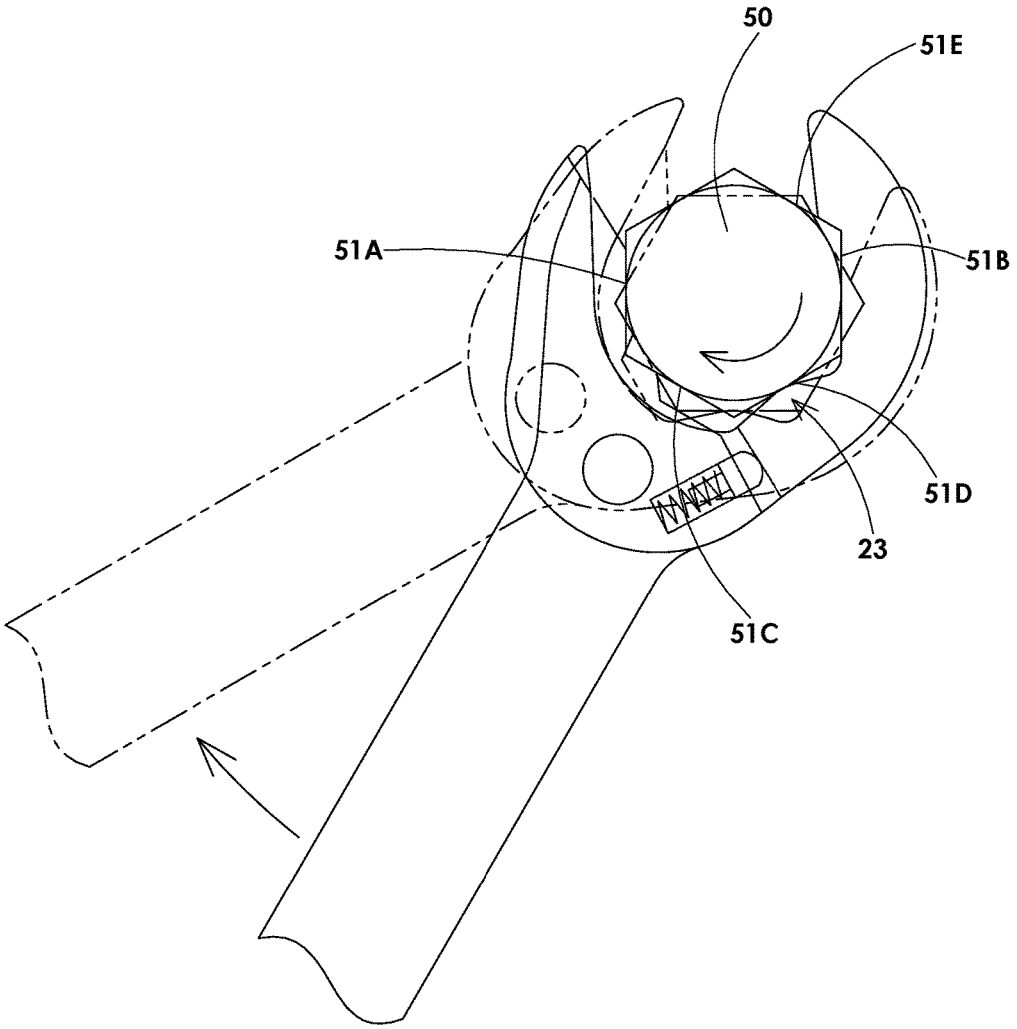
FIG. 9 is a schematic view of the present invention when in use, illustrating that the hexagonal screw member is screwed by the open-end wrench.
Figure 10:
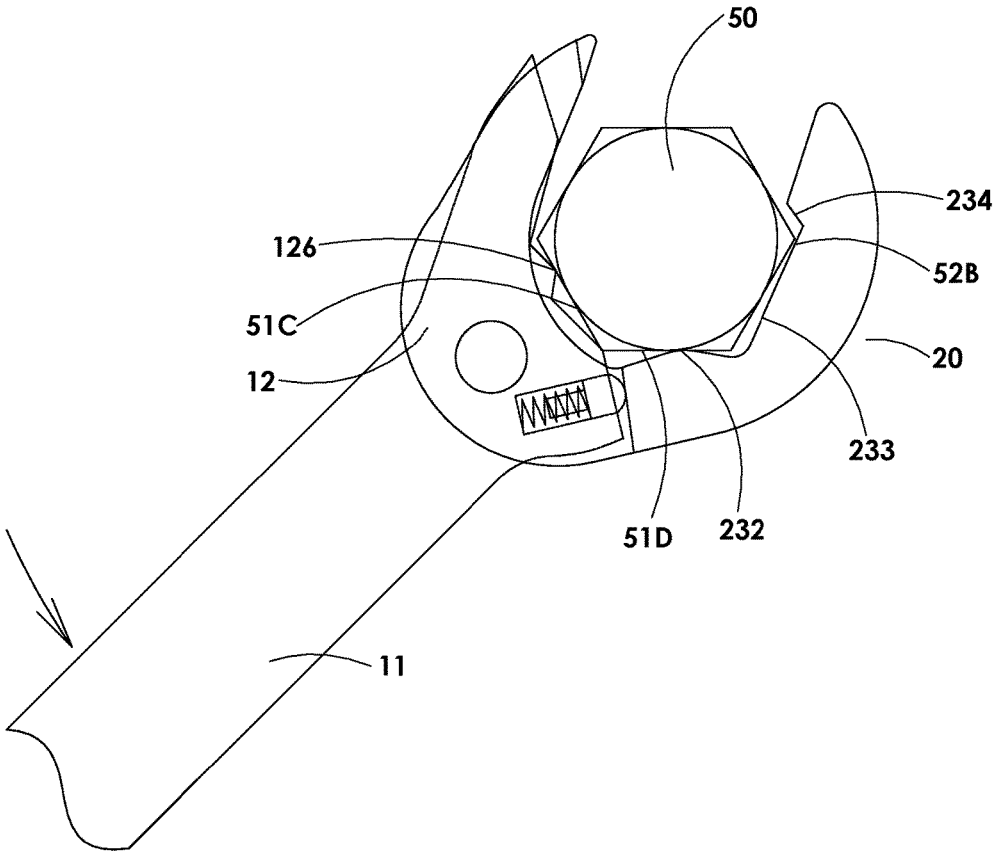
FIG. 10 is a schematic view of the present invention when in use, illustrating the initial action of the backswing operation.
Figure 11:
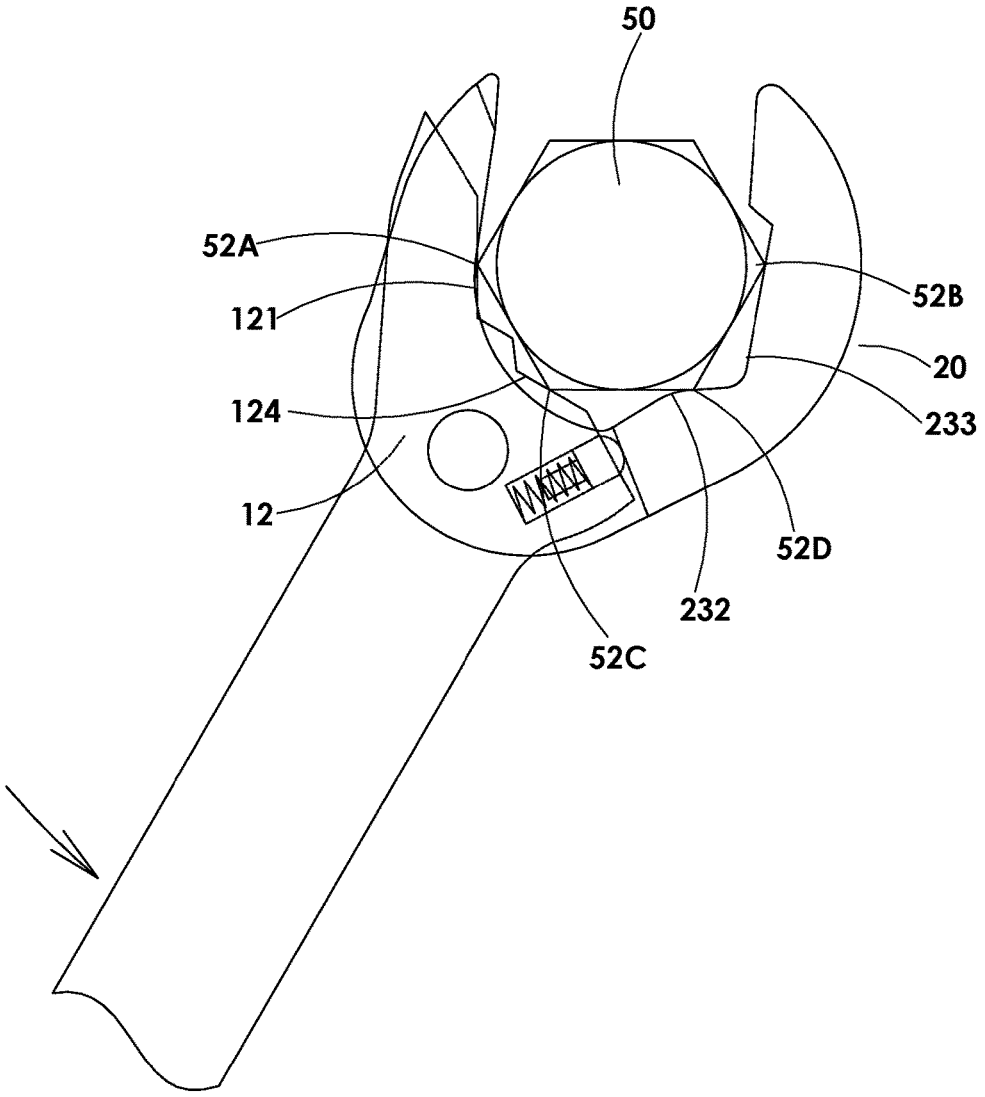
FIG. 11 is a schematic view of the present invention when in use, illustrating that the corner of the hexagonal screw member opens the jaw opening during the backswing operation.
Figure 12:
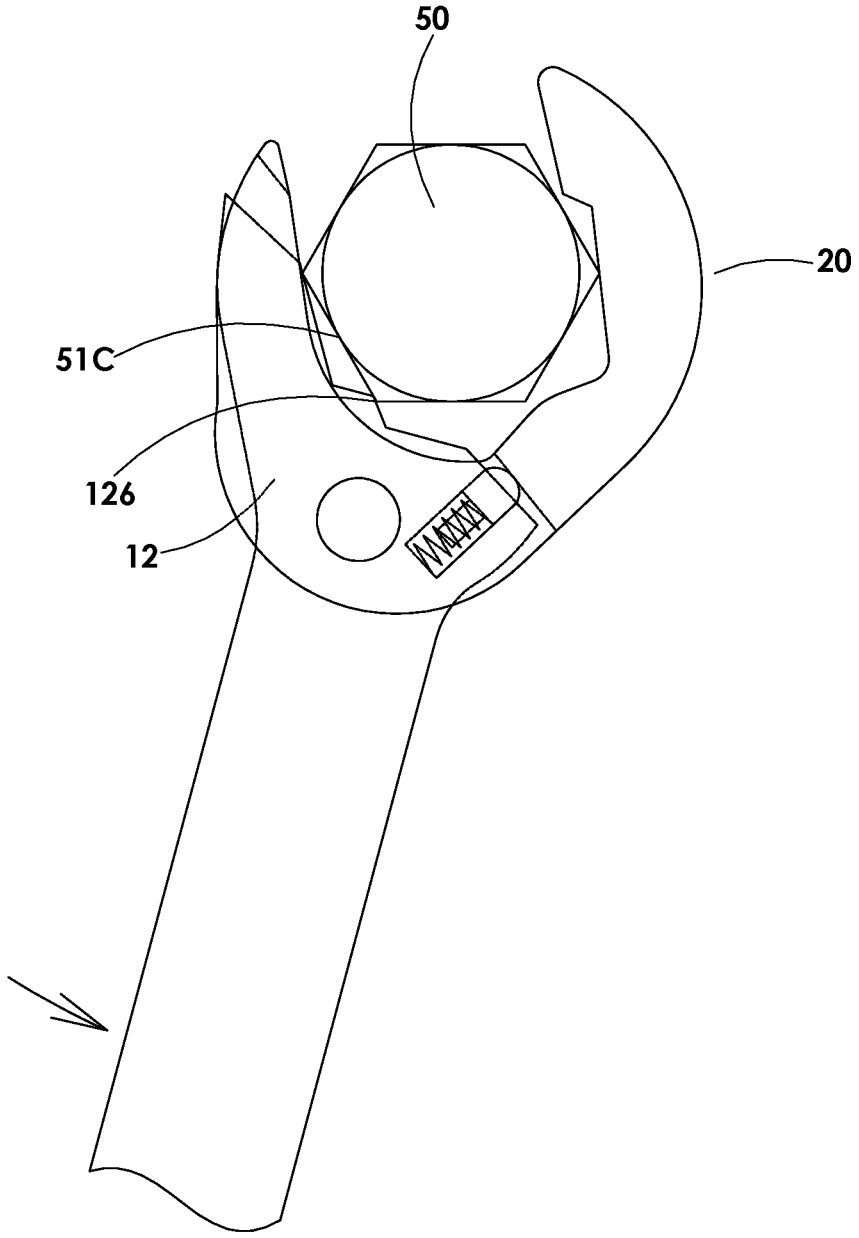
FIG. 12 is a schematic view of the present invention when in use, illustrating that the swing support point is going to leave one inner side of the hexagonal screw member to another inner side.
Figure 13:
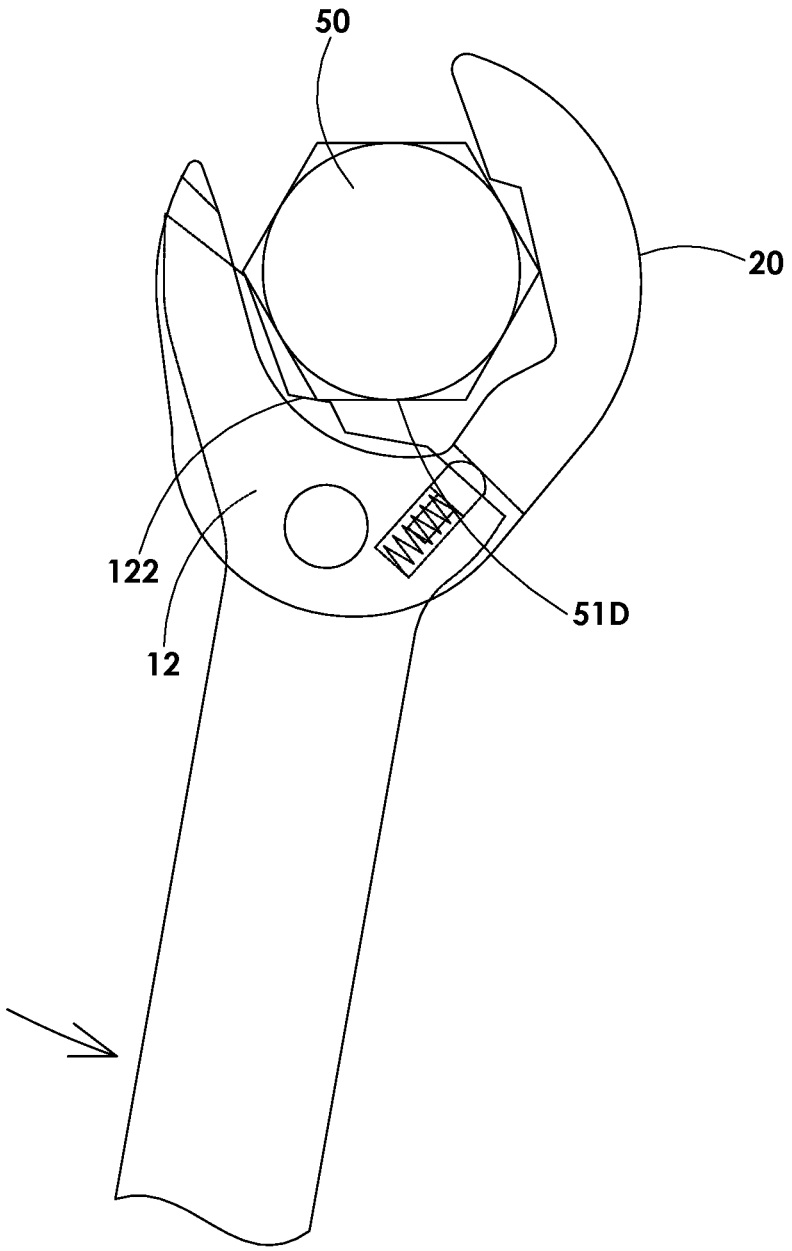
FIG. 13 is a schematic view of the present invention when in use, illustrating that the second clamping surface is in contact with the other inner side of the hexagonal screw member.

As shown in FIG. 4, when the user wants to use the open-end wrench to screw or unscrew the hexagonal screw member 50, the first entrance guide surface 230 and the second entrance guide surface 235 at the front ends of the extension arm 22 and the clamping arm 24 of the jaw 20 guide a pair of sides 51A, 51B of the hexagonal screw member 50. As shown in FIG. 5, during the process that the hexagonal screw member 50 enters the jaw opening 23, a corner 52A of the hexagonal screw member 50 is first in contact with the inclined guide surface 120 to be guided. As shown in FIG. 6, the second entrance guide surface 235 of the jaw 20 is pushed by one side 51B of the hexagonal screw member 50 to generate a corresponding swing motion, and then the first clamping surface 121 following the inclined guide surface 120 guides one side 51A of the hexagonal screw member 50 so that the hexagonal screw member 50 is completely guided to enter the jaw opening 23. As shown in FIG. 7, it is only required that the swing support point 126 holds against the inner side 51C of the hexagonal screw member 50 as a rotation point, and the push portion 14 is operated to rotate a small angle by the handle portion 11 of the operating handle 10. The second entrance guide surface 235 is linked to move away from the initial side 51B of the hexagonal screw member 50. By the elastic push force applied to the push end surface 27 by the elastic member, as shown in FIG. 8, on that moment, the first, second, third and fourth clamping surfaces 121, 122, 233, 234 and the convex curved surface 232 simultaneously clamp the five sides 51A, 51B, 51C, 51D, 51E of the hexagonal screw member 50. As shown in FIG. 9, the five sides 51A, 51B, 51C, 51D, 51E of the hexagon screw member 50 can be clamped by the open-end wrench so that the hexagonal screw member 50 can be screwed or unscrewed. As shown in FIG. 10, when the user wants to stop screwing the hexagonal screw member 50, the handle portion 11 is swung back. The swing support point 126 holds against the inner side 51C of the hexagonal screw member 50 as a rotation point again, and the pushed head 12 is swung back. The convex curved surface 232 of the jaw 20 is pushed by another inner side 51D of the hexagonal screw member 50 so that the inclined angle between the third and fourth clamping surfaces 233, 234 is moved away from a corner 52B of the hexagonal screw member 50. As shown in FIG. 11, during the position change, the four corners 52A, 52B, 52C, 52D of the hexagonal screw member 50 abut against the first clamping surface 121, the third clamping surface 233, the backswing limit surface 124 and the convex curved surface 232. As shown in FIG. 12, the swing support point 126 leaves the inner side 51C of the hexagonal screw member 50. As shown in FIG. 13, the second clamping surface 122 is turned to the other inner side 51D of the hexagonal screw member 50. As shown in FIG. 8, the first, second, third and fourth clamping surfaces 121, 122, 233, 234 and the convex curved surface 232 are restored to clamp the five sides of the hexagonal screw member 50. As shown in FIG. 9, the hexagonal screw member 50 can be screwed or unscrewed by the handle portion 11. As shown in FIGS. 1, 2 and 3, according to the open-end wrench of the present invention, the push head 12 of the operating handle 10 is accommodated in the coupling slot 25 of the jaw 20. The portion of the inclined guide surface 120, the first and second clamping surfaces 121, 122 and the swing support point 126 normally extend to the jaw opening 23. As shown in FIGS. 4, 5, 6, 7 and 8, when the open-end wrench is used to screw or unscrew the hexagonal screw member 50, the first entrance guide surface 230 and the second entrance guide surface 235 of the jaw 20 guide the pair of sides 51A, 51B of the hexagonal screw member 50 for the hexagonal screw member 50 to enter the jaw opening 23, and the five sides of the hexagonal screw member 50 can be clamped quickly to enhance the convenience for screwing or unscrewing the hexagonal screw member 50. In addition, as shown in FIG. 9, the hexagonal screw member 50 won't slide out of the jaw opening 23 during the backswing process of the operating handle 10 so as to screw or unscrew the hexagonal screw member 50 stably.

According to the aforesaid embodiment, wherein, as shown in FIG. 2 and FIG. 3, the first entrance guide surface 230 of the jaw 20 is formed with an outward slanted guide surface 230A at a front end thereof. As shown in FIG. 4 and FIG. 5, when the first entrance guide surface 230 and the second entrance guide surface 235 are used for guiding the pair of sides 51A, 51B of the hexagonal screw member 50, the outward slanted guide surface 230A is configured to guide the pair of sides 51A, 51B of the hexagonal screw member 50 to the first entrance guide surface 230 and the second entrance guide surface 235.

According to the aforesaid embodiment, wherein, as shown in FIG. 2 and FIG. 3, an outer edge of the front end of the extension arm 22 of the jaw 20 is formed with a rounded corner 220 connected with the first entrance guide surface 230. As shown in FIG. 4 and FIG. 5, when the front end of the extension arm 22 contacts the hexagonal screw member 50, the rounded corner 220 facilitates the pair of sides 51A, 51B of the hexagonal screw member 50 to be slid to the first and second entrance guide surfaces 230, 235.

According to the aforesaid embodiment, wherein, as shown in FIG. 2 and FIG. 3, an outer edge of the front end of the clamping arm 24 of the jaw 20 is formed with a rounded corner 240 connected with the second entrance guide surface 235. As shown in FIG. 4 and FIG. 5, when the front end of the clamping arm 24 contacts the hexagonal screw member 50, the rounded corner 240 facilitates the pair of sides 51A, 51B of the hexagonal screw member 50 to be slid to the first and second entrance guide surfaces 230, 235.

According to the aforesaid embodiment, wherein, as shown in FIG. 2 and FIG. 3, the elastic member 30 in the hole 16 of the support end surface 125 is a compression spring. A cap-shaped push member 31 is provided at an outer end of the elastic member 30. An outer end of the push member 31 is formed with a spherical surface 310. The spherical surface 310 is against the push end surface 27. The spherical surface 310 of the push member 31 acts on the push end surface 27 with low friction resistance, as shown in FIGS. 10, 11, 12, 13, so that the push head 12 and the jaw 20 can be turned or swung more flexibly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An open-end wrench, comprising an operating handle and at least one jaw;

the operating handle including a handle portion, at least one end of the handle portion being provided with a push head, the push head having a pivot hole, one side of a front end of the pivot hole extending obliquely to form a push portion having a substantially pointed cone shape, another side of the front end of the pivot hole extending obliquely and outwardly to form a support portion connected with the push portion, a front end surface of the push portion connected with the support portion being formed with an inclined guide surface, a first clamping surface, a second clamping surface, a turning surface, a backswing limit surface and a support end surface arranged in sequence; the inclined guide surface being an inward inclined plane formed at a front end of the push portion; the first clamping surface being inclined inwardly and connected to an inner end of the inclined guide surface; the second clamping surface being inclined outwardly and connected to an inner end of the first clamping surface, the second clamping surface being inclined at an angle to match with an included angle between two adjacent sides of a hexagonal screw member; the turning surface being inclined inwardly and connected to an inner end of the second clamping surface, the junction of the turning surface and the second clamping surface forming a swing support point; the backswing limit surface being inclined outwardly and connected to an inner end of the turning surface and serving as a stepped extension surface of the second clamping surface; the support end surface being connected to an inner end of the backswing limit surface and being inclined inwardly to connect an outer edge of the support portion, the support end surface being formed with a hole, the hole being provided with an elastic member therein;

the jaw having a C-like shape, the jaw having a connecting hole corresponding to the pivot hole of the push head of the operating handle, one side of a front end of the connecting hole extending obliquely to form an extension arm, another side of the front end of the connecting hole being bent obliquely to form a clamping arm connected with the extension arm, a jaw opening being defined between the extension arm and the clamping arm, the jaw having a coupling slot which extends from a root of the clamping arm to a position close to a front end of the extension arm and is in communication with the jaw opening and passes through an outer side edge of the extension arm, the coupling slot being formed with a swing limit end face near the front end of the extension arm and a push end face at the root of the clamping arm, the push head of the operating handle being mounted in the coupling slot by a pivot member inserted in the connecting hole and the pivot hole so that the jaw is pivotally connected to the push head of the operating handle, a gap being defined between the support end surface and the push end surface, the push end surface being biased by the elastic member so that the swing limit end surface abuts against the front end of the inclined guide surface to restrict the jaw from swinging in a direction on the push head; a peripheral end surface of the jaw opening formed by the extension arm and the clamping arm being formed with a first entrance guide surface, a concave curved surface, a convex curved surface, a third clamping surface, a fourth clamping surface and a second entrance guide surface arranged in sequence; the first entrance guide surface being formed on an inner edge of the front end of the extension arm and being tangent to the inclined guide surface so that a portion of the inclined guide surface extends to the jaw opening; the concave curved surface being connected to the first entrance guide surface, the first clamping surface and the second clamping surface extending to the jaw opening; the convex curved surface being connected to the concave curved surface and being formed at the root of the clamping arm and symmetrical to the swing support point; the third clamping surface being connected to the convex curved surface and cooperating with the first clamping surface to match two opposite sides of the hexagonal screw member; the fourth clamping surface being connected to the third clamping surface and cooperating with the second clamping surface to match two opposite sides of the hexagonal screw member; the second entrance guide surface being connected to the fourth clamping surface and formed on an inner edge of a front end of the clamping arm, the second entrance guide surface cooperating with the first entrance guide surface to match two opposite sides of the hexagonal screw member for guiding the hexagonal screw member to enter the jaw opening.

2. The open-end wrench as claimed in claim 1, wherein the first entrance guide surface of the jaw is formed with an outward slanted guide surface at a front end thereof for the first entrance guide surface and the second entrance guide surface to guide a pair of sides of the hexagonal screw member.

3. The open-end wrench as claimed in claim 1, wherein an outer edge of the front end of the extension arm of the jaw is formed with a rounded corner connected with the first entrance guide surface.

4. The open-end wrench as claimed in claim 1, wherein an outer edge of the front end of the clamping arm of the jaw is formed with a rounded corner connected with the second entrance guide surface.

5. The open-end wrench as claimed in claim 1, wherein the elastic member in the hole of the support end surface is a compression spring, a cap-shaped push member is provided at an outer end of the elastic member, an outer end of the push member is formed with a spherical surface, the spherical surface is against the push end surface, and the spherical surface of the push member acts on the push end surface with low friction resistance.

* * * * *